US006637163B2

(12) United States Patent
Thibault et al.

(10) Patent No.: US 6,637,163 B2
(45) Date of Patent: Oct. 28, 2003

(54) DECKING

(75) Inventors: Gary J. Thibault, Oscoda, MI (US); Kevin J. Beliveau, Oscoda, MI (US); Matthew J. Gary, Oscoda, MI (US); Ralph Brege, Lincoln, MI (US); David A. Witt, Oscoda, MI (US); Edward L. Ivinson, Oscoda, MI (US); Robin Colbath, Oscoda, MI (US)

(73) Assignee: GT Plastics Inc., Oscoda, MI (US)

( * ) Notice: Subject to any disclaimer, the term of this patent is extended or adjusted under 35 U.S.C. 154(b) by 191 days.

(21) Appl. No.: 09/912,892

(22) Filed: Jul. 25, 2001

(65) Prior Publication Data

US 2003/0019171 A1 Jan. 30, 2003

(51) Int. Cl.[7] ..... E04F 15/00

(52) U.S. Cl. ..... 52/177; 411/401; 411/174; 411/531

(58) Field of Search ..... 52/177, 581, 588.1, 52/589.1, 591.1, 592.1, 650.3; 411/401, 174, 424, 531

(56) References Cited

U.S. PATENT DOCUMENTS

| | | | | |
|---|---|---|---|---|
| 1,632,395 A | | 6/1927 | Fellows | |
| 2,748,591 A | | 6/1956 | Brown | |
| 2,923,384 A | | 2/1960 | Black | |
| 3,075,802 A | | 1/1963 | Lowe | |
| 3,110,371 A | | 11/1963 | De Ridder | |
| 3,229,438 A | | 1/1966 | Flagan | |
| 3,368,315 A | | 2/1968 | Thurnau | |
| 3,593,468 A | | 7/1971 | Bustin | |
| 3,614,915 A | | 10/1971 | Perry | |
| 4,100,710 A | * | 7/1978 | Kowallik | 403/353 |
| 4,102,104 A | | 7/1978 | Taylor et al. | |
| 4,177,615 A | * | 12/1979 | Anderson | 52/309.9 |
| 4,184,301 A | * | 1/1980 | Anderson et al. | 52/309.9 |
| 4,244,151 A | * | 1/1981 | Seem | 52/309.9 |
| 4,266,381 A | | 5/1981 | Deller | |
| 4,283,897 A | * | 8/1981 | Thompson | 52/478 |
| 4,316,351 A | * | 2/1982 | Ting | 52/309.9 |
| 4,892,052 A | | 1/1990 | Zook et al. | |
| 5,050,362 A | | 9/1991 | Tal et al. | |
| D332,148 S | | 12/1992 | Tal et al. | |
| 5,170,605 A | | 12/1992 | Huddle | |
| 5,394,672 A | * | 3/1995 | Seem | 52/591.1 |
| 5,425,210 A | * | 6/1995 | Zafir | 52/309.4 |

(List continued on next page.)

FOREIGN PATENT DOCUMENTS

| | | |
|---|---|---|
| CA | 835016 | 2/1970 |
| CH | 401422 | of 1966 |
| DE | 2614279 | 10/1977 |
| DK | 75409 | 2/1953 |
| FR | 1509652 | of 1967 |
| FR | 1524750 | of 1968 |
| GB | 834138 | 5/1960 |

*Primary Examiner*—Ramon O. Ramirez
*Assistant Examiner*—Kofi Schulterbrandt
(74) *Attorney, Agent, or Firm*—Price, Heneveld, Cooper, DeWitt & Litton

(57) ABSTRACT

A deck including a panel, a retainer and a fastener. The panel includes a flange having an aperture therein. The retainer includes an upper leg and a lower leg embracing the flange therebetween, with the lower leg having a fastener receiving opening. The fastener is for attaching the panel to structural framework, with the fastener including a shoulder. The fastener extends through the aperture of the flange and the opening of the lower leg of the retainer. The shoulder extends through the aperture in the flange and abuts against the lower leg of the retainer to secure the retainer. Furthermore, the shoulder is sufficiently tall as to prevent the fastener from tightly clamping the flange. Additionally, the flange embraced between the upper leg and the lower leg of the retainer is adapted to expand between the upper leg and the lower leg. Therefore, thermal expansion of the panel is accommodated.

38 Claims, 6 Drawing Sheets

U.S. PATENT DOCUMENTS

| | | | | |
|---|---|---|---|---|
| D366,943 | S | | 2/1996 | Sheehy |
| 5,535,567 | A | | 7/1996 | Cahoon |
| 5,647,184 | A | | 7/1997 | Davis |
| 5,729,947 | A | | 3/1998 | Dawes |
| 5,758,467 | A | | 9/1998 | Snear et al. |
| 5,811,035 | A | * | 9/1998 | Mockry ..... 261/111 |
| 5,819,491 | A | | 10/1998 | Davis |
| 5,881,508 | A | | 3/1999 | Irvine et al. |

* cited by examiner

DECKING

BACKGROUND OF THE INVENTION

The present invention relates to decking, and in particular to deck panels.

Deck panels have been used to cover decks of houses, boat docks, floating docks and other structures having a surface exposed to the environment. Deck panels for decking provide a support surface for people walking on the decking.

Heretofore, deck panels have been placed on a structural framework. The structural framework preferably includes dimensional lumber or aluminum pieces fastened together by typical means, such as nails and screws. The deck panels have thereafter been fastened or otherwise fixedly attached to the structural framework. Deck panels have been made of materials including wood or metal planking. However, wood planking tends to warp, splinter and rot, thereby shortening the life span of the deck panels. Likewise, metal planking tends to corrode in a humid environment and often becomes uncomfortably hot in direct sunlight.

Deck panels have recently been constructed of thermoplastic materials to prolong the life of the deck panels and to maintain the safety of the decking. However, thermoplastics have a tendency to expand in heat and contract in cold. Consequently, thermoplastic deck panels cannot be tightly secured to the structural framework without causing damage to the deck panels as they expand and contract. Since the deck panels are typically secured tightly to the structural framework, the deck panels can have a relatively short life span because of the damage done to the deck panels by the fasteners as the deck panels expand and contract.

Accordingly, an apparatus solving the aforementioned disadvantages and having the aforementioned advantages is desired.

SUMMARY OF THE INVENTION

In the deck panels of the present invention, thermal expansion and contraction are accommodated without sacrificing secure fastening by providing an oversized fastener receiving aperture in a panel attachment mounting flange, a retainer which embraces the mounting flange at the fastener receiving aperture, and a fastener having a shoulder which passes through the mounting flange and a bottom leg of the retainer, with the shoulder of the fastener seating securely on the bottom leg of the retainer.

Accordingly, the deck can be placed onto a structural framework and can expand and contract in various weather conditions without causing cracks or other failures in the deck panels. The deck panels are easy and economical to manufacture, easy to install, efficient in use, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
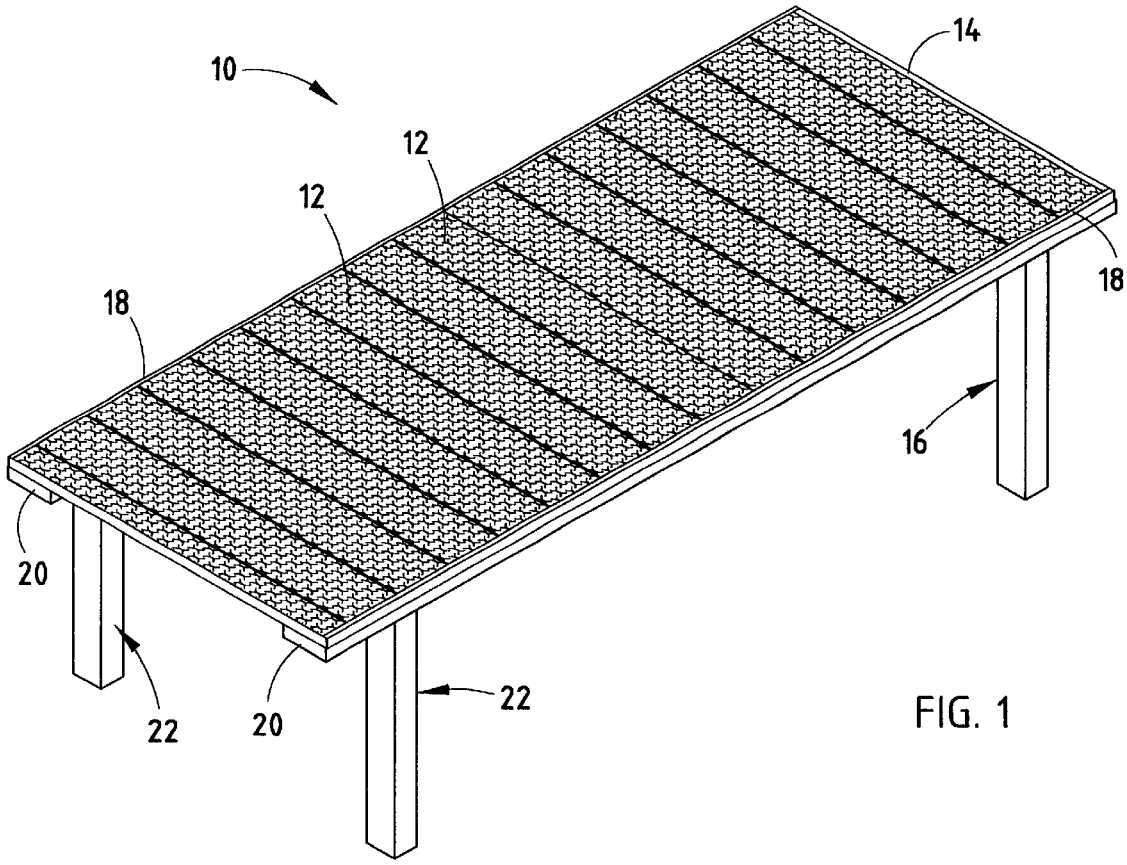
FIG. 1 is a perspective view of a deck embodying the present invention on a structural framework.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a deck embodying the present invention. The deck 10 preferably includes a plurality of deck panels 12 and a starter panel 14 placed onto a structural framework 16. The starter panel 14 assists in connecting the deck panels 12 to the structural framework 16. The deck 10 also preferably includes a trim strip 18 covering ends of the deck panels 12 and the ends of the starter panel 14.

In the illustrated example, the structural framework 16 is a dock having a pair of support surfaces 20 and legs 22 for supporting the support surfaces 20 above the ground. The structural framework 16 preferably includes dimensional lumber or aluminum pieces fastened together by typical means, such as nuts and bolts. Although the structural framework 16 is shown as being a dock, the structural framework 16 could be any framework, including commercial and residential decks and docks. Furthermore, the supporting surfaces 20 of the structural framework 16 could be supported above the ground with legs 22 as shown in FIG. 1 or could be placed directly on the ground. The term structural framework as defined herein includes any structure that could support the deck 10 and have the deck panels 12 connected thereto.

Figure 2:
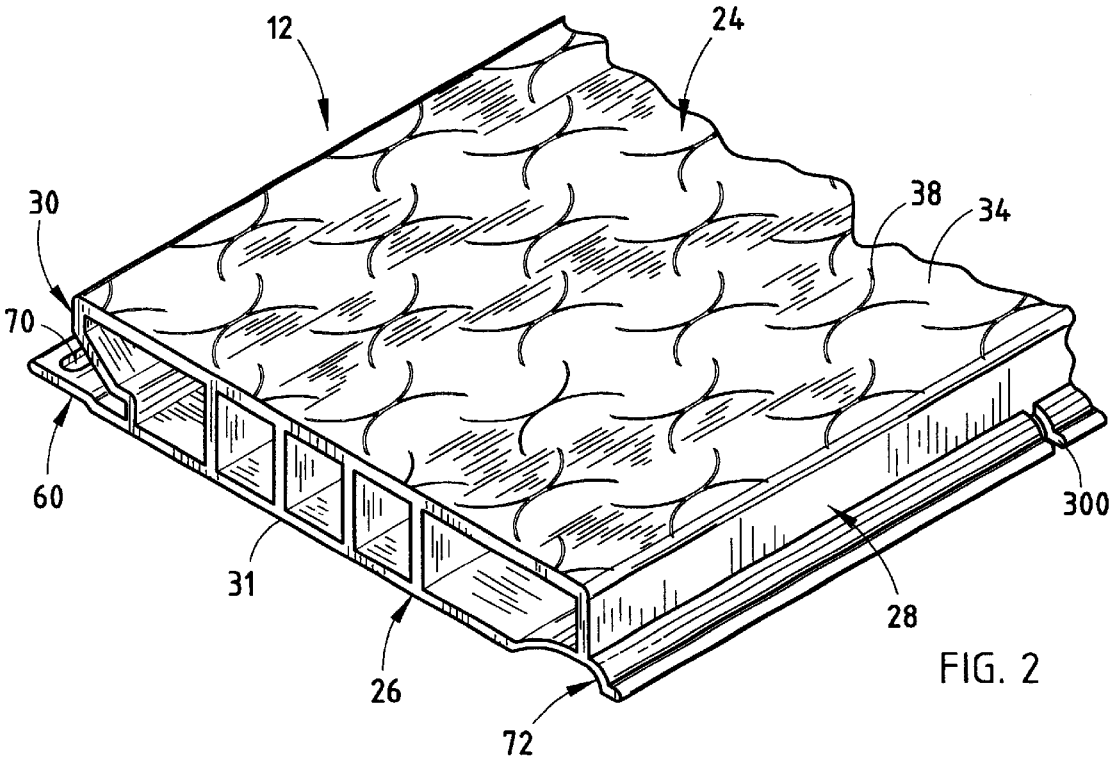
FIG. 2 is a partial perspective view of a deck panel of the present invention.
Figure 3:
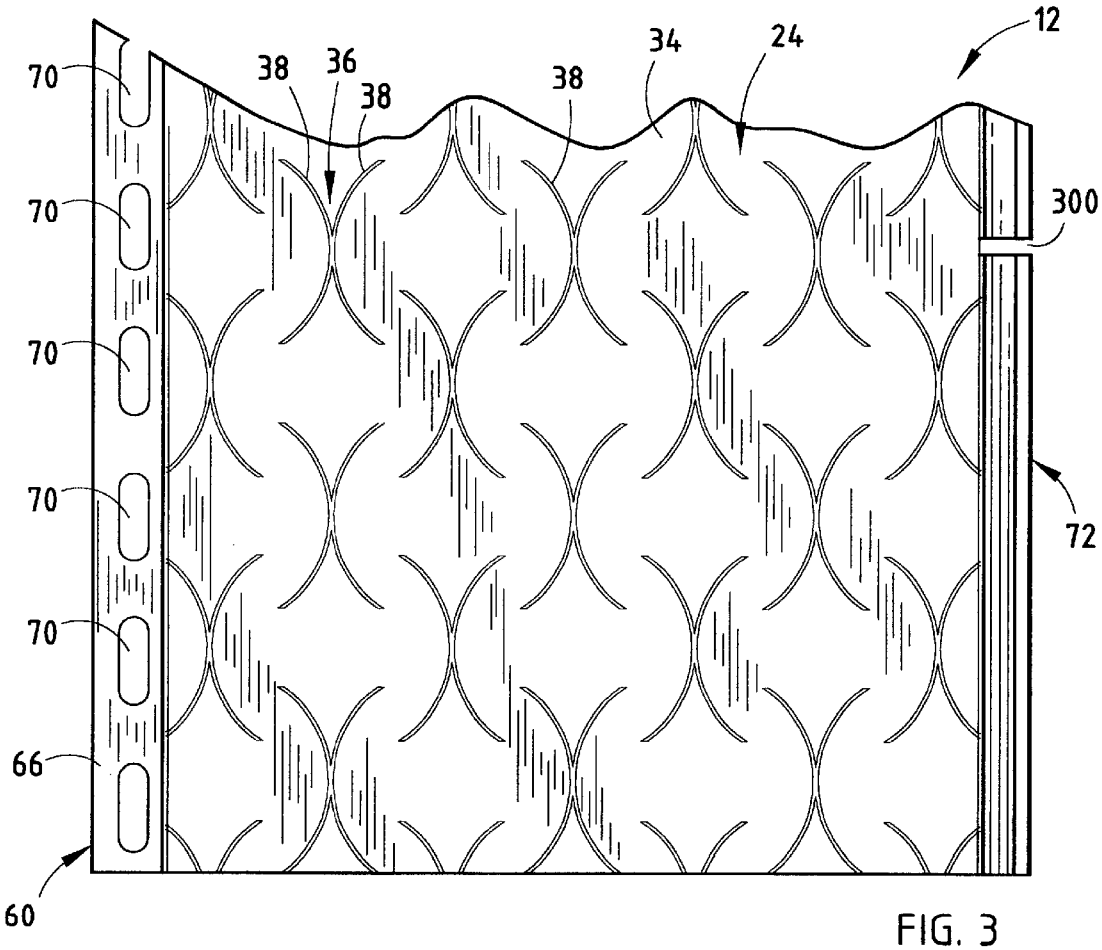
FIG. 3 is a partial top view of the deck panel of the present invention.
Figure 4:
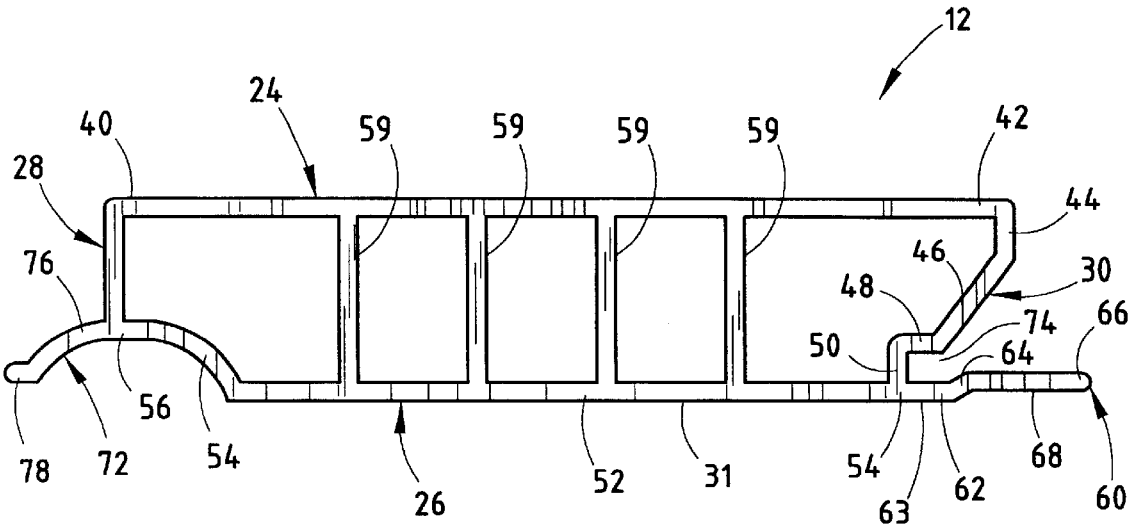
FIG. 4 is a side view of the deck panel of the present invention.

The illustrated deck panels 12 (FIGS. 2–4) are placed onto the structural framework 16 to provide a walking surface for the structural framework 16. Each deck panel 12 has a substantially rectangular cross-section and includes a top wall 24, a bottom wall 26, a first side wall 28 and a second side wall 30. The bottom wall 26 of the deck panel 12 has a bottom surface 31 that largely rests upon the support surface 20 of the structural framework 16. The deck panels 12 are preferably made out of a thermoplastic material, such as rigid PVC or composites. The top wall 24 of the deck panel 12 includes a top surface 34 having a plurality of substantially X-shaped channels 36 and ridges 38 surrounding the X-shaped channels 36. The X-shaped channels 36 and associated ridges 38 are aligned in off-set rows along the top surface 34 of the top wall 24. Since the deck panels 12 are typically used on decks and docks, the deck panels 12 can get wet from rain, lake water, etc. The X-shaped channels 36 and ridges 38 assist in providing traction to the top surface 34 of the deck panels 12. Therefore, the deck panels 12 are supported on the structural framework 16 and allow people to easily and safely walk upon the deck panels 12.

In the illustrated example, the first side wall 28 and the second side wall 30 of the deck panels 12 connect the top wall 24 to the bottom wall 26. The first side wall 28 is connected to a first side edge 40 of the top wall 24 and the second side wall 32 is connected to a second side edge 42 of the top wall 24. The top wall 24 is preferably horizontal and the first side wall 28 extends vertically downward from the first side edge 40 of the top wall 24. The second side wall 30 includes a first vertical portion 44 extending downward from the second side edge 42 of the top wall 24, an angled portion 46 extending towards the first side wall 28, a horizontal portion 48 also extending towards the first side wall 28, and a second vertical portion 50. The bottom wall 26 has a horizontal portion 52 extending from a second side union 54 with the second side wall 24 towards the first side wall 30 and an arched portion 54 extending upwards to a first side union 56 with the first side wall 30. The horizontal portion 52 of the bottom wall 26 has the bottom surface 31 that rests on the support surface 20 of the structural framework 16. The deck panel 12 also preferably includes a plurality of parallel, planar struts 59 extending between the top wall 24 and the bottom wall 26 of the deck panel 12 to support the top wall 24.

The illustrated deck panel 12 includes a mounting flange 60 extending from the second side union 54 of the bottom wall 26 and the second side wall 30. The mounting flange 60 includes a first portion 62 having a bottom surface 63 coplanar with the bottom surface 31 of the bottom wall 26, a second angled portion 64 extending away from the second side wall 30, and a third portion 66 having a bottom surface 68 parallel to the bottom surface 63 of the first portion 62 of the mounting flange 60 and the bottom surface 31 of the bottom wall 26. The mounting flange 60 includes a plurality of aligned oval fastener receiving apertures 70 aligned along the length of the third portion 66 of the mounting flange 60. As explained in more detail below, the fastener receiving apertures 70 in the mounting flange 60 assists in connecting the deck panel 12 to the structural framework 16. Furthermore, the fastener receiving apertures 70 allow the mounting flange 60 to thermally expand and contract without damaging the deck panel 12.

In the illustrated example, the deck panel 12 includes a tongue 72 and a groove 74 for connecting adjacent deck panels 12 together. The groove 74 is located between the mounting flange 60 and the second side wall 30. The groove 74 is defined by the first portion 62 of the mounting flange 60, the second vertical portion 50 of the second side wall 30 and the horizontal portion 48 of the second side wall 30. The tongue 72 extends from the first side union 56 of the first side wall 28 and the bottom wall 26. The tongue 72 includes a curved portion 76 extending away and downward from the first side union 56 and a short tab 78 extending horizontally from the curved portion 76. The short tab 78 of the tongue 72 extends into the groove 74 of an adjacent deck panel 12 when the deck 10 is constructed.

Figure 5:
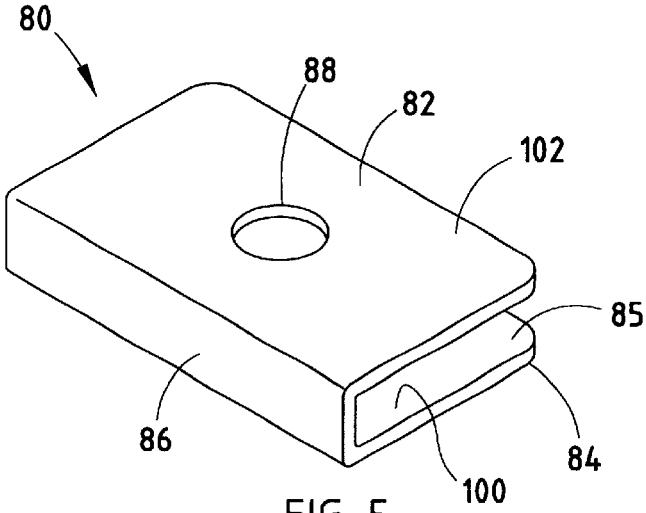
FIG. 5 is a perspective view of a retainer of the present invention.
Figure 6:
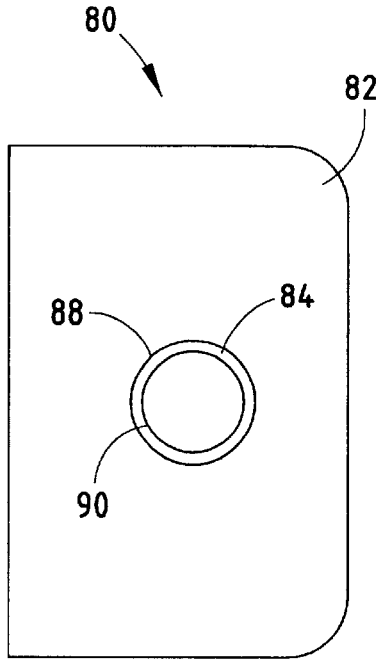
FIG. 6 is a top view of the retainer of the present invention.
Figure 7:
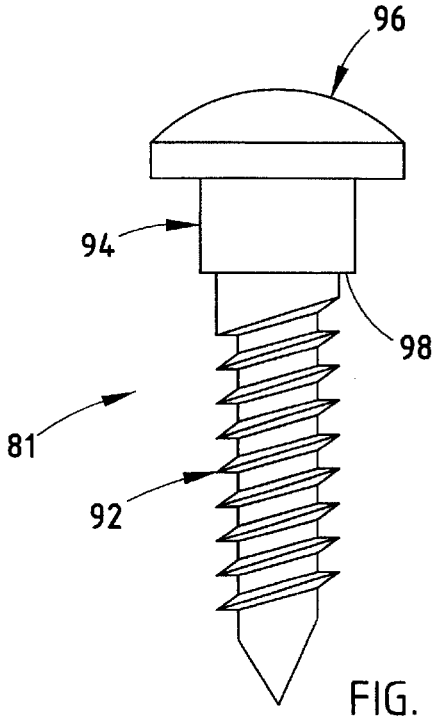
FIG. 7 is a side view of a fastener of the present invention.

In the illustrated example, retainer 80 (FIGS. 5 and 6) and a fastener 81 (FIG. 7) attach the deck panels 12 to the structural framework 16. The retainer 80 is a U-shaped clip and includes an upper leg 82, a lower leg 84 and a connecting portion 86 connecting the upper leg 82 and the lower leg 84. The upper leg 82 and the lower leg 84 define a slot 85 therebetween. The upper leg 82 of the retainer 80 includes a hole 88 and the lower leg 84 includes a fastener receiving opening 90 aligned with and concentric to the hole 88 in the upper leg 82. As seen in FIG. 6, the hole 88 in the upper leg 82 has a larger diameter than the fastener receiving opening 90 in the lower leg 84. As explained in more detail below, the fastener 81 is inserted through the hole 88 in the upper leg 82 and the fastener receiving opening 90 in the lower leg 82 to secure the retainer 80 and the deck panel 12 to the structural framework 16. The fastener 81 includes a threaded portion 92, a circular shoulder 94 and a head 96. The shoulder 94 has a diameter smaller than the hole 88 in the upper leg 82 of the retainer 80, but a larger diameter than the fastener receiving opening in the lower leg 84 of the retainer 80.

To connect the deck panels 12 to the structural framework 16, retainers 80 are connected to the deck panels 12 by inserting the mounting flange 60 of a first deck panel 12 into the slot 85 of the retainer 80. The number of retainers 80 used to connect each deck panel 12 to the structural framework 16 can vary, depending on the length of the deck panels 12 and the configuration of the structural framework 16. Two retainers 80 should be used to connect each deck panel 12 to the structural framework 16 having a pair of parallel beams as the support surfaces 20, with one retainer 80 for connecting the deck panel 12 to each beam. The hole 88 in the upper leg 82 of the retainer 80 and the fastener receiving opening 90 in the lower leg 84 of the retainer 80 are aligned with the fastener receiving aperture 70 in the mounting flange 60 of the first deck panel 12. The first deck panel 12 is then placed onto the structural framework 16 and the fasteners 81 are inserted through each retainer 80, through the fastener receiving aperture 70 in the mounting flange 60, and into the structural framework 16.

As the fasteners 81 are inserted through each retainer 80 and the mounting flange 60, the shoulder 94 of the fastener 81 is allowed to pass through the hole 88 in the upper leg 82 of the retainer 80 and the fastener receiving aperture 70 in the mounting flange 60. However, since the shoulder 94 has a larger diameter than the fastener receiving opening 90 in the lower leg 84 of the retainer 80, a bottom surface 98 of the shoulder 94 will not be able to pass through the fastener receiving opening 90 in the lower leg 84 and will press against a top surface 100 of the lower leg 84 of the retainer 80 to secure the lower leg 84 of the retainer 80 against the structural framework 16 (see FIG. 8). Furthermore, the height of the shoulder 94 is larger than the distance between the top surface 100 of the lower leg 84 and a top surface 102 of the upper leg 82 of the retainer 80. Therefore, the head 96 of the fastener 81 does not press against the top surface 102 of the upper leg 82 and the mounting flange 60 of the deck panel 12. The thermoplastic material of the deck panel 12, and in particular the mounting flange 60, is therefore allowed to expand and force the top leg 82 and the bottom leg 84 of the retainer 80 apart without applying a force against the fastener 82.

Figure 9:
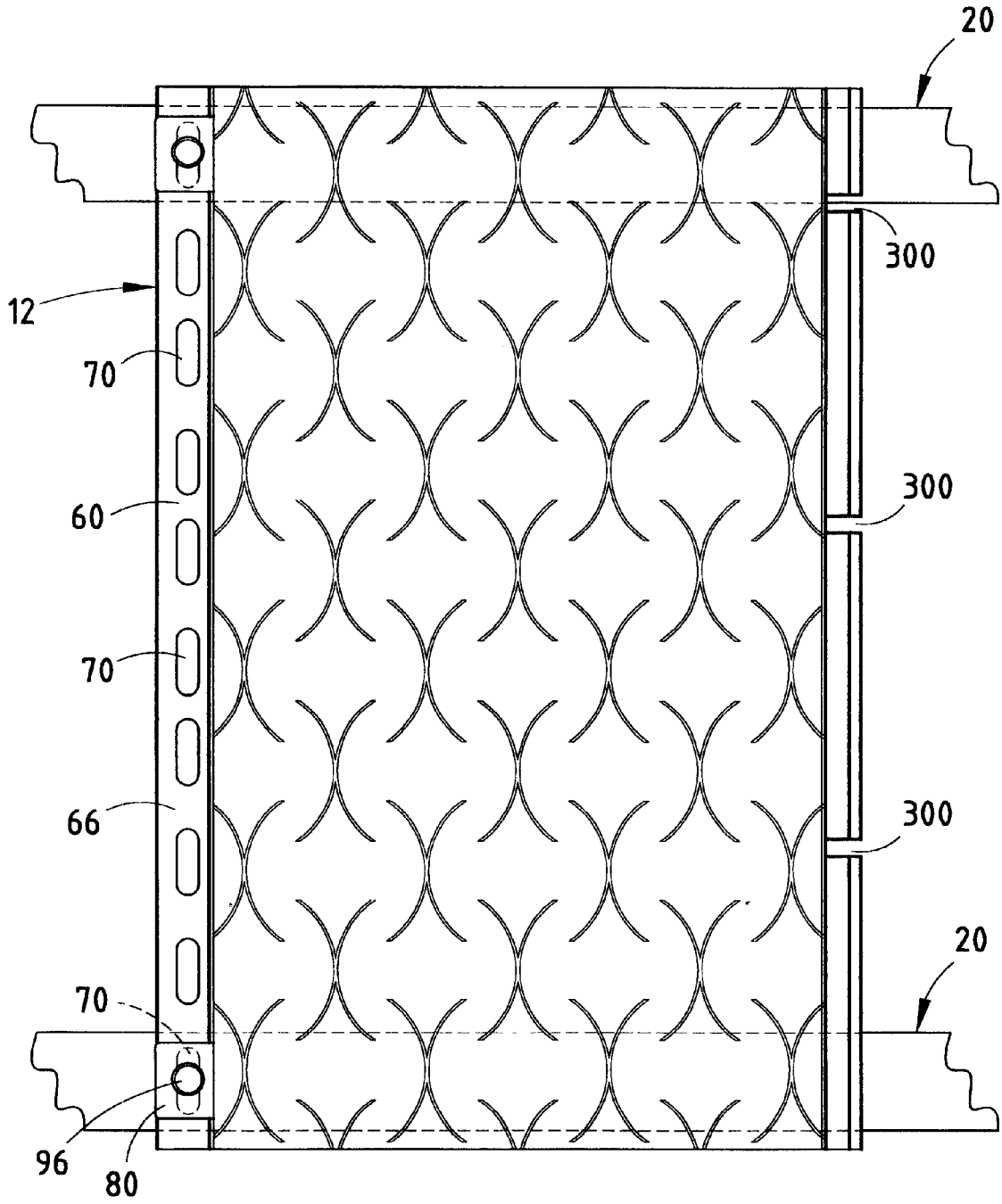
FIG. 9 is a top view of the deck panel connected to the structural framework.

Since the fastener receiving apertures 70 are oval shaped, fasteners 81 are allowed to slide within the apertures 70 as the deck panels 12 expand in the longitudinal direction (see FIG. 9). The longest diameter of the oval apertures 70 are preferably parallel to the longitudinal direction of the deck panels 12. Since the deck panels 12 will experience most of the thermal expansion in the longitudinal direction because that is the direction of most of the material of the deck panels 12, the apertures 70 will move more in the longitudinal direction with the expansion than in any other direction. Therefore, the apertures 70 are preferably oval to allow the apertures 70 to slide about the fasteners 81 as the apertures 70 move in the longitudinal direction during thermal expansion of the deck panels 12. Since the deck panels 12 have a much shorter lateral dimension compared to the longitudinal direction, the apertures 70 will not move very far in the lateral direction. Consequently, the apertures 70 can be oval because the deck panels 12 and their associated apertures 70 will not move very far in the lateral direction.

After the first deck panel 12 has been connected to the structural framework 16, more deck panels 12 are positioned next to the first deck panel 12 to build the deck 10. Therefore, the tongue 72 of a second deck panel 12 is then inserted into the groove 74 of the first deck panel 12 to connect the first deck panel 12 to the second deck panel 12. The second deck panel 12 is thereafter connected to the structural framework 16 with one of the retainers 80 and fasteners 81 as described above for the first deck panel 12. More deck panels 12 are thereafter connected to the deck panels 12 connected to the structural framework 16 in the manner described above.

Figure 10:
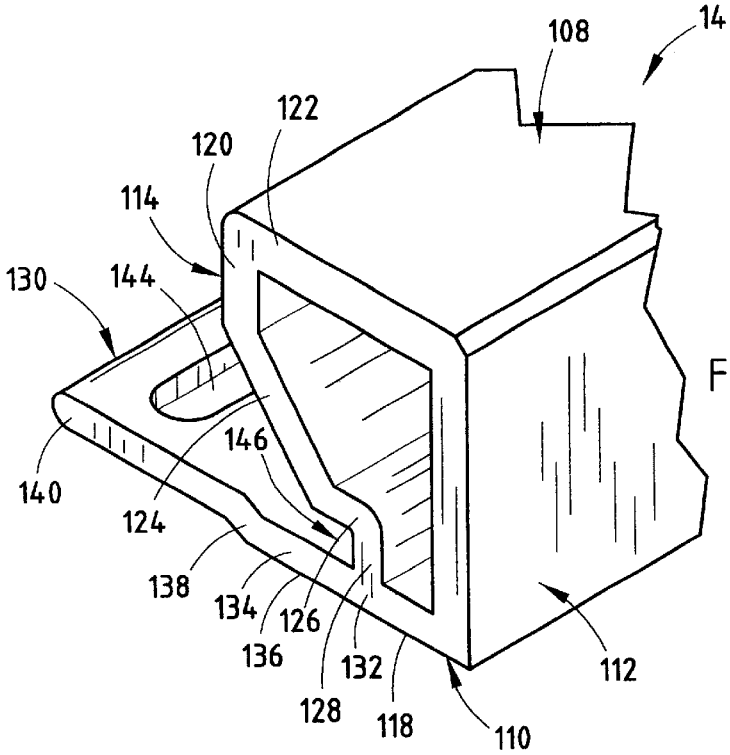
FIG. 10 is a partial perspective view of a starter panel of the present invention.
Figure 11:
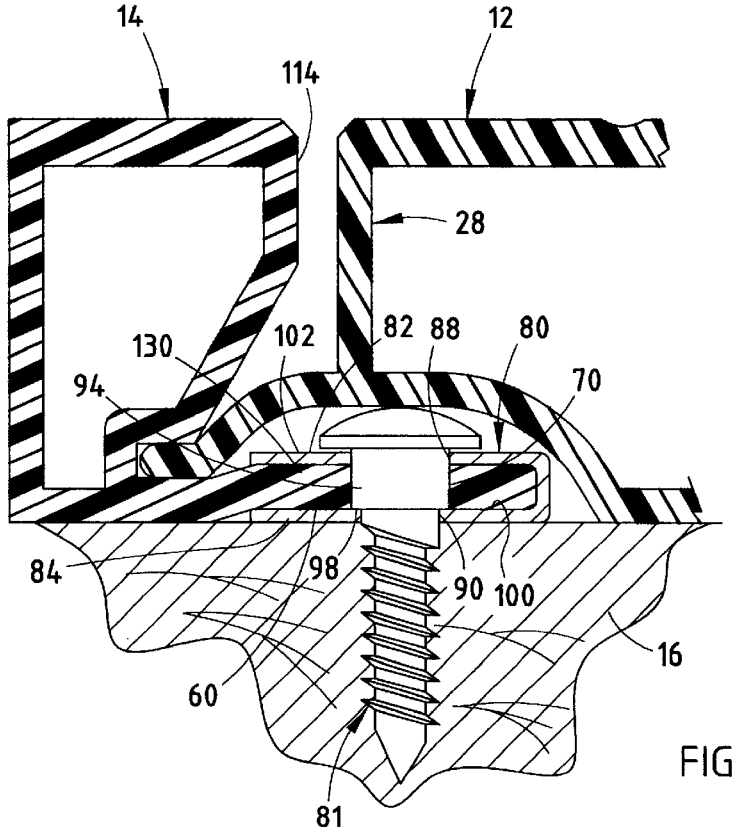
FIG. 11 is a partial cross-sectional view of the deck panel connected to a starter panel of the present invention.

In the illustrated example, the deck 10 preferably includes the starter panel 14 (FIGS. 10 and 11). The starter panel 14 is similar to the deck panel 12 and has a substantially rectangular cross-section. The starter panel 14 includes a top wall 108, a bottom wall 110, a first side wall 112 and a second side wall 114. The bottom wall 110 of the starter panel 14 has a bottom surface 118 that rests upon the support surface 20 of the structural framework 16. The first side wall 112 and the second side wall 114 of the starter panel 14 connect the top wall 108 to the bottom wall 110. The top wall 108 is preferably horizontal and the first side wall 112 extends vertically downward from the top wall 108 to the bottom wall 110. The second side wall 114 of the starter panel 14 has the same configuration as the second side wall 30 of the deck panel 12. The second side wall 114 of the starter panel 14 therefore includes a first vertical portion 120 extending downward from a second side edge 122 of the top wall 108, an angled portion 124 extending towards the first side wall 112, a horizontal portion 126 also extending towards the first side wall 112, and a second vertical portion 128. The starter panel 14 is preferably made out of a thermoplastic material, such as rigid PVC or composites.

The illustrated starter panel 14 includes a starter panel mounting flange 130 for connecting the starter panel 14 to the structural framework 16. The starter panel mounting flange 130 is similar to the mounting flange 60 of the deck panel 12 and extends from a second side union 132 of the bottom wall 110 and the second side wall 114 of the starter panel 14. The starter panel mounting flange 130 includes a first portion 134 having a bottom surface 136 coplanar with the bottom surface 118 of the bottom wall 110, a second angled portion 138 extending away from the second side wall 114, and a third portion 140 having a bottom surface 142 parallel to the bottom surface 136 of the first portion 134 of the starter panel mounting flange 130 and the bottom surface 118 of the bottom wall 110. The starter panel mounting flange 130 includes a plurality of aligned oval fastener receiving apertures 144 aligned along the length of the third portion 140 of the starter panel mounting flange 130.

In the illustrated example, the starter panel 14 includes a groove 146 for accepting the tongue 72 of an adjacent deck panel 12 for connecting the starter panel 14 to the adjacent deck panel 12. The groove 146 is located between the starter panel mounting flange 130 and the second side wall 114. The groove 146 is defined by the first portion 134 of the starter panel mounting flange 130, the second vertical portion 128 of the second side wall 114 and the horizontal portion 126 of the second side wall 114.

The illustrated starter panel 14 is connected to the structural framework 16 using the retainer 80 and the fastener 81 in the same manner as the connection of the deck panel 12 to the structural framework 16. Therefore, the starter panel mounting flange 130 is inserted into the slot 85 of the retainer 80 and placed on the structural framework 16. The starter panel 14 is preferably placed adjacent an edge of the structural framework 16 such that the starter panel 14 and the deck panels 12 will cover the entire structural framework 16. The fasteners 81 are then placed through each retainer 80, through the fastener receiving aperture 144 in the mounting flange 130, and into the structural framework 16. The fasteners 81 abut against the lower leg 84 of the retainer 80 and therefore allow the starter panel 14 to expand and contract in the same manner as the deck panel 12 described above. The tongue 72 of the deck panel 12 is inserted into the groove 146 of the starter panel 12 and the deck panel 12 is thereafter connected to the structural framework 16 as described above. Additional deck panels 12 are also used to construct the deck 10 through the use of tongues 72 and grooves 74 of adjacent deck panels 12, retainers 80 and fasteners 81, also as described above.

When the deck panels 12 are used on a deck that abuts against a structure, the deck panel 12 adjacent the structure may have to be shortened or cut along its width in order to be able to abut the structure. Therefore, the final deck panel 12, or the deck panel 12 that abuts the structure, is cut along its longitudinal direction such that the tongue 72 of the final deck panel 12 may be inserted into the groove 74 of the full deck panel 12 closest to the structure and then have the bottom surface 31 of the bottom wall 26 of the final deck panel 12 rest on the support surfaces 20 of the structural framework 16. Holes (not shown) are then drilled into the top wall 24 and bottom wall 26 of the final deck panel 12 along the end edges of the top wall 24. Fasteners (not shown) are then inserted into the holes along the end edges of the top wall 24 and bottom wall 26 and into the structural framework 16. Heads of the fasteners are not placed flush against a top surface of the bottom wall 26, thereby allowing the final deck panel 12 to expand and contract. In an alternative configuration, the starter panel 14 could be placed adjacent the structure and the last deck panel 12 of the deck 10 away from the structure could be screwed to the structural framework 16 as described above with fasteners inserted into holes along the top edge of the top wall 24 and the bottom wall 26 and into the structural framework 16.

Figure 12:
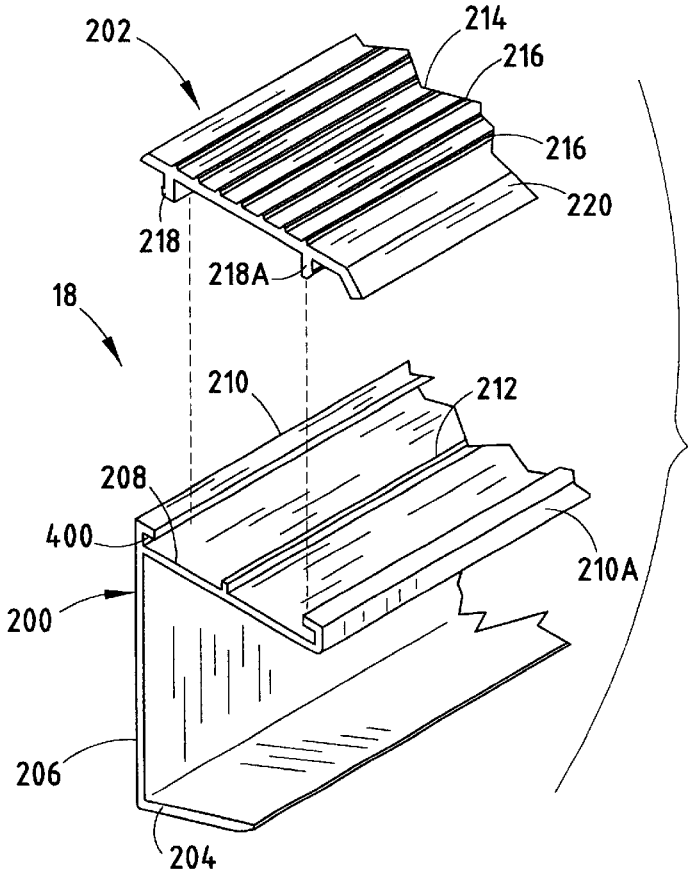
FIG. 12 is a partial perspective exploded view of a trim panel of the present invention.

In the illustrated example, the deck panels 12 and starter panel 14 preferably include trim strips 18 (FIG. 12) placed along the end edges of the panels 12 and 14 to cover the open side edges of the panels 12 and 14 and to cover the holes drilled into the final deck panel 12. The trim strip 18 preferably includes a C-shaped cover member 200 and a trim panel 202. The C-shaped cover member 200 includes a bottom arm 204, a side arm 206 and a top arm 208. The top arm 208 and the side arm 206 are preferably perpendicular and the bottom arm 204 preferably extends from the side arm 206 at an acute angle such that the top arm 208 and the bottom arm 204 are biased against each other. The top arm 208 includes a pair of inverted, inwardly facing L-shaped fingers 210 and 210A extending from side edges of the top arm 208 along the length of the top arm 208. The top arm 208 also includes an elongate mounting flange 212 extending along the length of the top arm 208 between the L-shaped fingers 210 and 210A. The L-shaped fingers 210 and 210A connect the trim panel 202 to the C-shaped cover member 200 and the elongate mounting flange 212 helps to support the trim panel 202 above the top arm 208. The trim panel 202 includes a plate 214 having a plurality of parallel ribs 216 along a top surface of the trim panel 202 and a pair of outwardly facing L-shaped rails 218 and 218A extending from a bottom surface of the trim panel 202. The pair of outwardly facing L-shaped rails 218 and 218A of the trim panel 202 are configured to be snapped over the top arm 208 of the C-shaped cover member 200 between the pair of inverted, inwardly facing L-shaped fingers 210 and 210A of the C-shaped cover member 200 to connect the trim panel 202 of the C-shaped cover member 200. Preferably, one of the L-shaped rails 210 is inserted into a channel 400 defined between one of the L-shaped fingers 210 and the top arm 208 and then the other L-shaped rails 210A is snapped over the other of the L-shaped fingers 210 to connect the C-shaped cover member 200 to the trim panel 202. The trim panel 202 also includes a downwardly slanted mounting flange 220 extending from a side edge of the plate 214 of the trim panel 202 that covers one of the pair of inverted, inwardly facing L-shaped fingers 210 and 210A when the trim panel 202 is connected to the C-shaped cover member 200.

The illustrated trim strips 18 are connected to the deck panels 12 and the starter panel 14 by placing the C-shaped cover member 200 over end edges of the deck panels 12 and the starter panel 14 (see FIG. 1). Christmas-tree shaped push pins (not shown) are then placed through holes in the top arm 208 of the C-shaped cover member 200 and the top wall 24 of the deck panel 12 or the top wall 108 of the starter panel 14 to connect the C-shaped cover member 200 of the panels 12 and 14, respectively. Furthermore, since the top arm 208 and the bottom arm 204 of the C-shaped cover member 200 are biased towards each other, the C-shaped cover member 200 will be frictionally held in place on the panels 12 and 14. The trim panel 202 of the trim strip 18 is then snapped over the top arm 208 of the C-shaped cover member 200 as described above to cover the screws in the C-shaped cover member 200.

Figure 8:
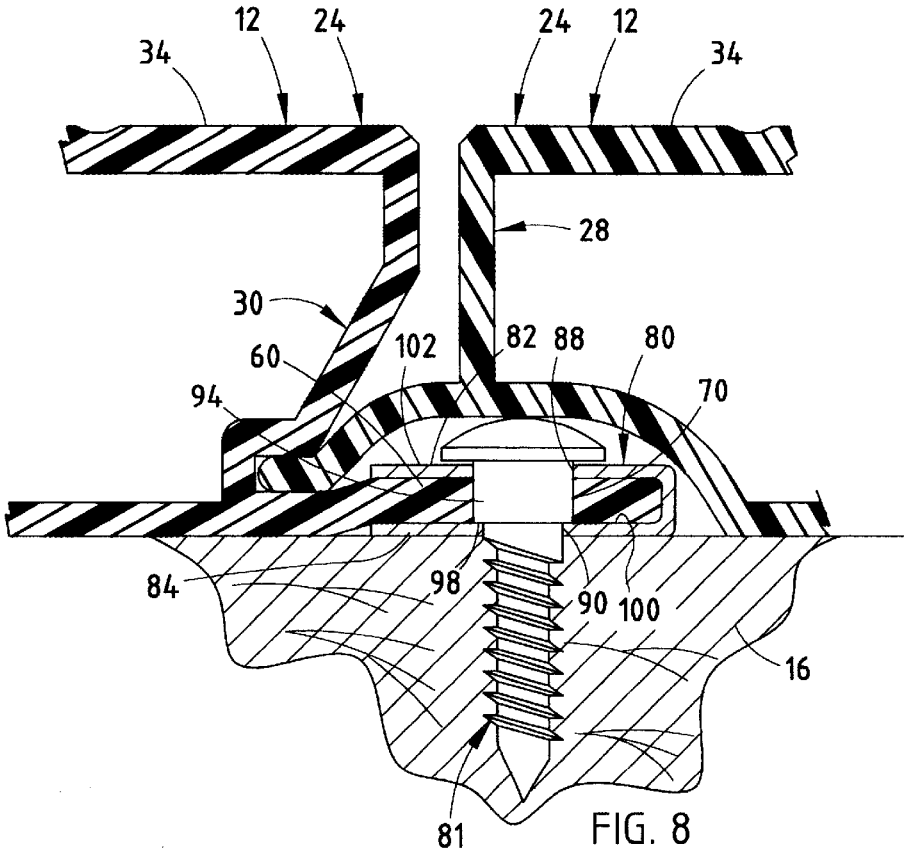
FIG. 8 is a partial cross-sectional view of a pair of deck panels connected together and to a structural framework.

In the illustrated example, the deck panels 12 preferably include notches 300 (FIG. 3) in the tongue 72 spaced along the length of the tongue 72 to assist in draining water from the top surface 34 of the top wall 24 of the deck panel 12. As best seen in FIG. 8, water on the top surface 34 of the top wall 24 of the deck panel 12 can run between the first side wall 28 and the second side wall 30 of adjacent deck panels 12, through the notches 300 and through the unused fastener receiving apertures 70 in the mounting flanges 66 of the deck panels 12. Furthermore, as best seen in FIG. 11, water can also run between the first side wall 28 of the deck panel 12 and the second side wall 114 of the starter panel 14, though the notches 300 and through unused fastener receiving apertures 144 in the mounting flanges 130 of the starter panel 14 adjacent the deck panel 12.

It will be readily appreciated by those skilled in the art that modifications may be made to the invention without departing from the concepts disclosed herein. For example, the trim strip 18 could have the bottom arm 204 co-planar with the side arm 206, thereby forming an L-shaped cover member for covering the side of the deck panels 12 and the starter panels 14. Such modifications are to be considered as included in the following claims, unless these claims by their language expressly state otherwise.

We claim:

1. A deck for placement on a structural framework comprising:

a panel including a mounting flange with at least one fastener receiving aperture therein;

a retainer including an upper leg and a lower leg embracing the mounting flange therebetween, the lower leg having a fastener receiving opening; and a fastener for attaching the panel to the structural framework, the fastener including a shoulder, the fastener extending through the fastener receiving aperture of the mounting flange and the fastener receiving opening of the lower leg of the retainer;

wherein the shoulder extends through the fastener receiving aperture in the mounting flange and abuts against the lower leg of the retainer to secure the retainer, the shoulder is sufficiently tall as to prevent the fastener from tightly clamping the mounting flange, and the mounting flange embraced between the upper leg and the lower leg of the retainer is adapted to expand between the upper leg and the lower leg of the retainer, thereby accommodating thermal expansion of the panel.

2. The deck of claim 1, wherein:

the retainer is U-shaped and includes a slot, with the upper leg and the lower leg defining the slot; and the mounting flange of the panel is located within the slot.

3. The deck of claim 2, wherein:

the upper leg of the retainer includes a hole; and the fastener extends through the hole of the upper leg of the retainer, the fastener receiving aperture of the mounting flange of the panel and the fastener receiving opening of the lower leg of the retainer.

4. The deck of claim 3, wherein:

the fastener further includes a head and a threaded portion;

the threaded portion is configured to be threaded into the supporting structure; and the head overlies the upper leg of the retainer.

5. The deck of claim 1, wherein:

the panel includes a tongue and a groove for connecting a plurality of panels together.

6. The deck of claim 1, wherein:

the panel is a starter panel for connecting a plurality of deck panels to the structural framework.

7. The deck of claim 1, wherein:

the panel includes a top wall, a bottom wall, a first side wall and a second side wall;

the mounting flange extends from the second side wall.

8. The deck of claim 7, wherein:

the top wall includes a top surface;

the top surface includes a plurality of channels; and each channel includes a ridge surrounding the channel, the ridge extending above the top surface.

9. The deck of claim 8, wherein:

each channel is substantially X-shaped.

10. The deck of claim 7, wherein:

the panel includes a tongue and a groove for connecting a plurality of panels together.

11. The deck of claim 10, wherein:

the tongue extends from at least one of the first side wall and the bottom wall; and the groove is defined by a portion of the second side wall and the mounting flange.

12. The deck of claim 7, wherein:

the panel further includes a plurality of planar columns extending between the top wall and the bottom wall for supporting the top wall.

13. The deck of claim 7, wherein:

the mounting flange includes a first portion and a second portion;

the first portion extends from a union of the second side wall and the bottom wall;

the second portion includes the fastener receiving opening; and the second portion having a bottom surface located above the bottom surface of the bottom wall of the panel for accommodating the second leg of the retainer therebeneath.

14. The deck of claim 1, wherein:

the fastener receiving aperture of the mounting flange of the panel is oval, thereby accommodating longitudinal expansion of the panel.

15. A deck for placement on a structural framework comprising:

a plurality of deck panels, each deck panel including a mounting flange with at least one fastener receiving aperture therein, each deck panel further including a tongue and groove;

a plurality of retainers, each retainer including an upper leg and a lower leg embracing the mounting flange therebetween, the lower leg having a fastener receiving opening; and a plurality of fasteners for attaching the deck panels to the structural framework, each fastener including a shoulder;

wherein each upper leg of each retainer overlies a portion of the mounting flange of one of the deck panels;

wherein the tongues and grooves on adjacent deck panels are engaged to connect the adjacent deck panels; and wherein the shoulder of each fastener extends through one of the fastener receiving apertures in the mounting flange and abuts against the lower leg of the retainer to secure the retainer and the deck panel to the structural framework, the shoulder is sufficiently tall as to prevent the fastener from tightly clamping the mounting flange, and the mounting flange embraced between the upper leg and the lower leg of the retainer is adapted to expand between the upper leg and the lower leg of the retainer, thereby accommodating thermal expansion of the panel.

16. The deck of claim 15, wherein:

the retainer is U-shaped and includes a slot, with the upper leg and the lower leg defining the slot; and the mounting flange of the panel is located within the slot.

17. The deck of claim 16, wherein:

the upper leg of each retainer includes a hole; and each fastener extends through one of the holes of the upper leg of the retainer, one of the fastener receiving apertures of the mounting flange of one of the deck panels and the fastener receiving opening of the lower leg of the one of the retainers.

18. The deck of claim 17, wherein:

each fastener further includes a head and a threaded portion;

the threaded portion is configured to be threaded into the supporting structure; and the head overlies the upper leg of the retainer.

19. The deck of claim 15, further including:

a starter panel including a starter mounting flange extending from the starter panel;

a starter panel retainer, the starter panel retainer including an upper leg and a lower leg, the lower leg of the starter panel retainer having a fastener receiving opening; and a starter panel fastener for attaching the starter panel to the structural framework, the starter panel fastener including a shoulder;

wherein the upper leg of the starter panel retainer overlies a portion of the mounting flange extending from the starter panel;

wherein the starter panel fastener extends through the fastener receiving opening in the lower leg of the starter panel retainer and the shoulder of the starter panel fastener abuts against the lower leg of the starter panel retainer to prevent the starter panel fastener from tightly clamping the mounting flange of the starter panel, so that thermal expansion of the starter panel is accommodated; and wherein the starter panel further includes at least one of a tongue and groove, at least one complementary groove and tongue of one of the deck panels being engaged with the at least one of a tongue and groove of the starter panel to connect the starter panel to the one of the deck panels.

20. The deck of claim 15, wherein:

the deck panels include a top wall, a bottom wall, a first side wall and a second side wall;

the mounting flange extends from the second side wall.

21. The deck of claim 20, wherein:

the top wall includes a top surface;

the top surface includes a plurality of channels; and each channel includes a ridge surrounding the channel, the ridge extending above the top surface.

22. The deck of claim 21, wherein:

each channel is substantially X-shaped.

23. The deck of claim 20, wherein:

the tongue extends from at least one of the first side wall and the bottom wall; and the groove is defined by a portion of the second side wall and the mounting flange.

24. The deck of claim 20, wherein:

the deck panel further includes a plurality of planar columns extending between the top wall and the bottom wall for supporting the top wall.

25. The deck of claim 20, wherein:

the mounting flange includes a first portion and a second portion;

the first portion extends from a union of the second side wall and the bottom wall;

the second portion includes the fastener receiving opening;

the second portion having a bottom surface located above the bottom surface of the bottom wall of the deck panel for accommodating the second leg of the retainer therebeneath.

26. The deck of claim 15, wherein:

each fastener receiving aperture of the mounting flange of the deck panels is oval, thereby accommodating longitudinal expansion of the panel.

27. A method of constructing a deck on a structural framework:

providing a plurality of deck panels, each deck panel including a mounting flange with at least one fastener receiving aperture therein, each deck panel further including a tongue and groove;

providing a plurality of retainers, each retainer including an upper leg and a lower leg, the lower leg having a fastener receiving opening;

providing a plurality of fasteners, each fastener including a shoulder;

placing a first one of the deck panels on the structural framework;

positioning a portion of the mounting flange of the first one of the deck panels between the upper leg and the lower leg of a first one of the fasteners;

inserting a first one of the fasteners through the fastener receiving aperture in the mounting flange of the deck panel and the fastener receiving opening in the lower leg of the first one of the retainers;

abutting the shoulder of the first one of the fasteners against the lower leg of the first one of the retainers to prevent the first one of the fasteners from tightly clamping the mounting flange of the first one of the deck panels, so that thermal expansion of the first one of the deck panels is accommodated;

mating at least one of the tongue and groove of a second one of the deck panels with a complementary one of the tongue and groove of the first one of the deck panels;

positioning a portion of the mounting flange of the second one of the deck panels between the upper leg and the lower leg of a second one of the fasteners;

inserting a second one of the fasteners through the fastener receiving opening in the lower leg of the second one of the retainers; and abutting the shoulder of the second one of the fasteners against the lower leg of the retainer to prevent the second one of the fasteners from tightly clamping the mounting flange, so that thermal expansion of the second one of the deck panels is accommodated.

28. The method of constructing the deck of claim 27, wherein:

each retainer is U-shaped and includes a slot, the upper leg and the lower leg of each retainer defining the slot; and further including the step of locating the mounting flange of each deck panel within one of the slots.

29. The method of constructing the deck of claim 28, wherein:

the upper leg of each retainer includes a hole;

and further including the step of extending each fastener through one of the holes of the upper leg of the retainer, one of the fastener receiving apertures of the mounting flange of the deck panels and one of the fastener receiving openings of the lower leg of the retainers.

30. The method of constructing the deck of claim 29, wherein:

each fastener further includes a head and a threaded portion; and further including the steps of threading the threaded portion of each fastener into the supporting structure; and placing the head over the upper leg of the retainer.

31. The method of constructing the deck of claim 27, further including:

providing a starter panel including a starter mounting flange extending from the starter panel;

providing a starter panel retainer including an upper leg and a lower leg, the lower leg having an fastener receiving opening; and providing a starter panel fastener including a shoulder;

placing the upper leg of the starter panel retainer over a portion of the mounting flange extending from the starter panel;

extending the starter panel fastener through the fastener receiving opening in the lower leg of the starter panel retainer;

abutting the shoulder of the starter panel fastener against the lower leg of the starter panel retainer to prevent the starter panel fastener from tightly clamping the mounting flange of the starter panel, so that thermal expansion of the starter panel is accommodated;

providing the starter panel with at least one of a tongue and groove; and engaging at least one complementary groove and tongue of one of the deck panels with the at least one of a tongue and groove of the starter panel to connect the starter panel to the one of the deck panels.

32. The method of constructing the deck of claim 27, further including:

providing the deck panels with a top wall, a bottom wall, a first side wall and a second side wall;

wherein the mounting flange extends from the second side wall.

33. The method of constructing the deck of claim 32, wherein:

the tongue extends from at least one of the first side wall and the bottom wall; and the groove is defined by a portion of the second side wall and the mounting flange.

34. The method of constructing the deck of claim 32, wherein:

the deck panel further includes a plurality of planar columns extending between the top wall and the bottom wall for supporting the top wall.

35. The method of constructing the deck of claim 32, wherein:

the mounting flange includes a first portion and a second portion;

the first portion extends from a union of the second side wall and the bottom wall;

the second portion includes the fastener receiving opening;

the second portion having a bottom surface located above the bottom surface of the bottom wall of the deck panel for accommodating the second leg of the retainer therebeneath.

36. The method of constructing a deck of claim 27, wherein:

each of the fastener receiving aperture of the mounting flange of the deck panels is oval, thereby accommodating longitudinal expansion of the panel.

37. The method of constructing the deck of claim 27, wherein:

the top wall includes a top surface;

and further including the step of embossing a plurality of channels into the top surface of each of the deck panels, thereby creating a ridge surrounding the channel that extends above the top surface of the top wall of the deck panel.

38. The method of constructing the deck of claim 37, wherein:

each channel is substantially X-shaped.

* * * * *